United States Patent [19]

Berkowitz

[11] 4,043,714

[45] Aug. 23, 1977

[54] SEAL GRID ASSEMBLY FOR ROTARY PISTON MECHANISM

[75] Inventor: Murray Berkowitz, Woodcliff Lake, N.J.

[73] Assignee: Curtiss-Wright Corporation, Wood-Ridge, N.J.

[21] Appl. No.: 689,184

[22] Filed: May 24, 1976

[51] Int. Cl.[2] ..... F01C 19/06; F01C 19/04; F04C 27/00

[52] U.S. Cl. ..... 418/123; 418/129; 418/156

[58] Field of Search ..... 418/123, 124, 125, 129, 418/221, 267, 268, 122, 156

[56] References Cited

U.S. PATENT DOCUMENTS

| | | | |
|---|---|---|---|
| 464,162 | 12/1891 | Mapes | 418/124 |
| 888,806 | 5/1908 | Hopkins | 418/124 |
| 3,549,110 | 12/1970 | Cotton | 418/61 A |
| 3,881,848 | 5/1975 | Huf | 418/124 |

FOREIGN PATENT DOCUMENTS

| | | | |
|---|---|---|---|
| 590,085 | 3/1925 | France | 418/124 |
| 50,527 | 5/1970 | Japan | 418/129 |

*Primary Examiner*—John J. Vrablik
*Attorney, Agent, or Firm*—Arthur Frederick; Victor D. Behn

[57] ABSTRACT

The improved seal grid assembly is for a rotary compressor or expansion engine of the type having a rotor supported for planetation in a multi-lobe housing cavity and comprises, in combination with a non-rotating seal at the juncture of the housing lobes, a sealing means including a sealing surface movable between a retracted position where it is out of engagement with the peripheral wall and an extended position where it is in engagement with the peripheral wall of the housing cavity. A vent passage means is also provided in the rotor to communicate a space defined between the sealing means and rotor with the working chambers to conduct gaseous fluid which pressurizes said space so as to provide movement of the sealing surface of the associated seal means to the retracted position just prior to engagement with the non-rotating seal and to the extended position after such engagement with the non-rotating seals at each of the housing lobe junctures.

13 Claims, 14 Drawing Figures

FIG.6
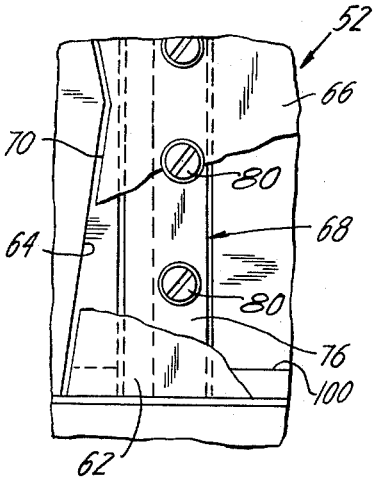
FIG.5
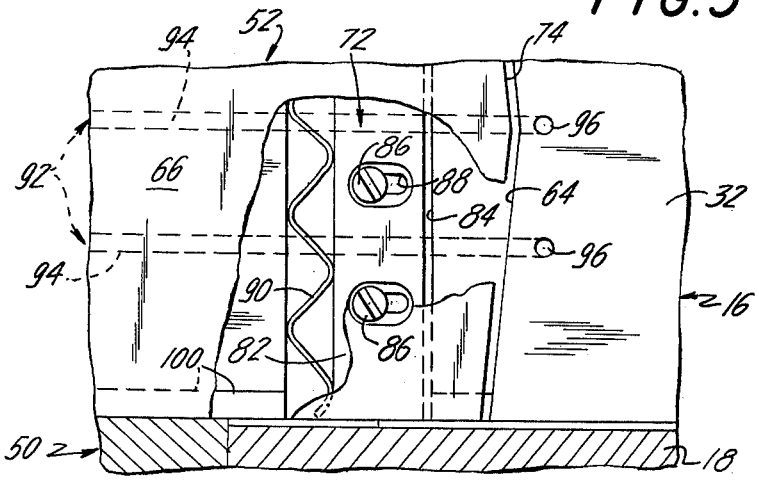
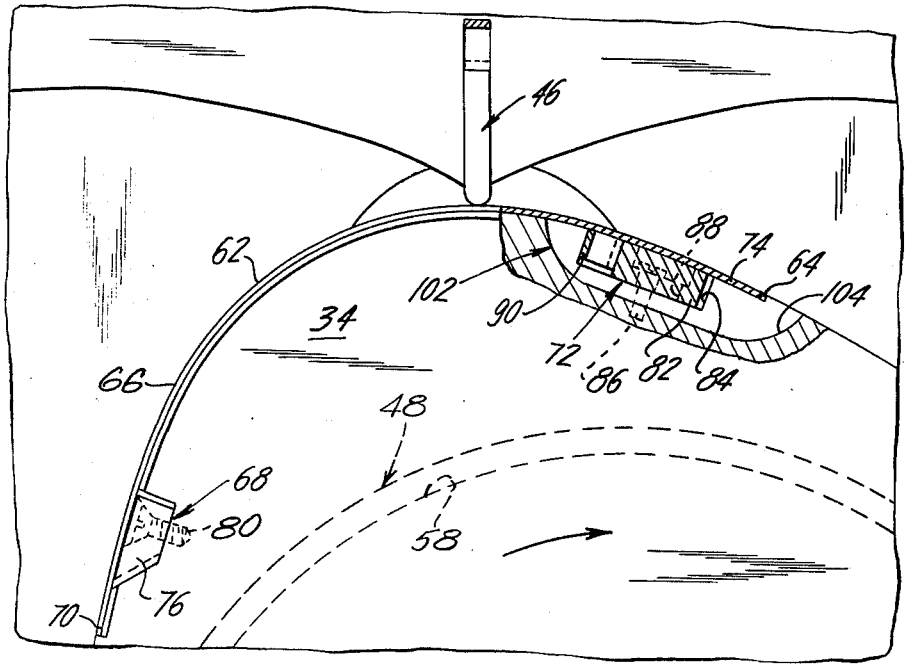
FIG.7
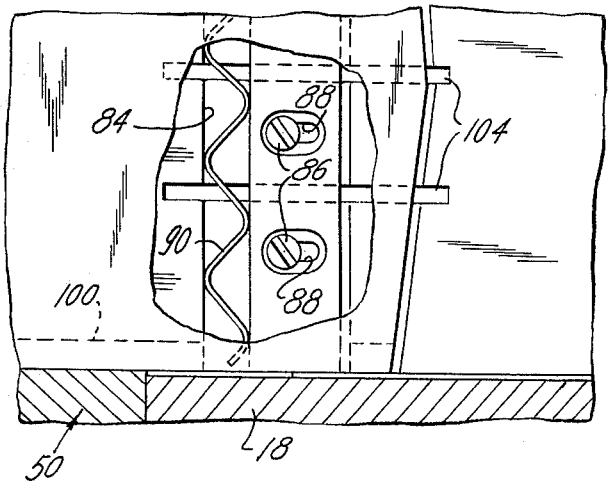
FIG.8

SEAL GRID ASSEMBLY FOR ROTARY PISTON MECHANISM

This invention relates to rotary piston mechanisms such as compressors and expansion engines, and more specifically, to an improved seal grid assembly for a rotary piston mechanism of the type having a rotor supported for planetary rotation in a multi-lobe housing cavity.

BACKGROUND OF THE INVENTION

In rotary piston mechanisms of various types having multi-lobe housing cavities, such as those described in the U.S. patents to Wankel et al., U.S. Pat. No. 2,988,065 dated June 13, 1961; Nubling, U.S. Pat. No. 2,866,417 dated Dec. 30, 1958; Kraic et al., U.S. Pat. No. 3,323,498 dated June 6, 1967; Kolbe et al., U.S. Pat. No. 3,671,154 dated June 20, 1972; Batten, U.S. Pat. No. 2,873,250 dated Mar. 25, 1975; Huf, U.S. Pat. No. 3,797,974 dated Mar. 19, 1974 and Huf, U.S. Pat. No. 3,923,430 dated Dec. 2, 1975, the working chambers formed between the rotor and the housing cavity walls are isolated from each other and surrounding areas by a sealing grid assembly comprising side wall sealing means and apex seals carried by the rotor or non-rotating seal elements disposed at the junctions of the housing cavity lobes. Heretofore, it was not considered possible to provide optimum volumetric efficiency by employing both apex seals and non-rotating seal elements (hereinafter referred to as "waist seals") because of the rapid failure of the seals due to the accumulative effects of repeated impacts between the apex seals and the non-rotating seal elements. While counterweighted apex seals which function to retract at the lobe junctures are known and disclosed in various U.S. patents, such as the patents to Jones, U.S. Pat. No. 3,456,626 dated July 22, 1969; Jones, U.S. Pat. No. 3,482,551 dated Dec. 9, 1969 and Kumar, U.S. Pat. No. 3,909,013 dated Sept. 30, 1975, the use of such apex seals in combination with waist seals would not eliminate the impact problem without an appreciable increase in leakage or blow-by at the apex seals. The prior art teaching, as exemplified in the U.S. Pat. No. 3,873,250 to Batten, and the French Pat. No. 590,085 to Planche, dated June 10, 1925, which disclose the pressurization of the apex seals to bias them outwardly of the grooves, even at the lobe junctures, obviously do not provide a solution to the impact problem.

Accordingly, it is an object of the present invention to provide an improved seal grid assembly for a rotary piston mechanism of the multi-lobe type which grid assembly includes both apex seals and waist seals.

Another object is to provide for a rotary piston mechanism of the multi-lobe type, an improved sealing grid assembly which effects an increase in the volumetric efficiency of the rotary piston mechanism as compared with mechanisms having heretofore known seal grid assemblies.

A still further object of this invention is to provide an improved seal grid assembly for a rotary piston mechanism of the multi-lobe type, having waist seals, which assembly includes apex seals each of which are capable of automatically moving between a retracted position where it is out of engagement with the peripheral wall of the multi-lobe cavity of the mechanism and an extended position where it is in engagement with the peripheral wall of the cavity to avoid thereby impacts between the apex seal and the waist seals.

SUMMARY OF INVENTION

Accordingly, the present invention contemplates an improved seal grid assembly for a rotary piston mechanism having a housing with axially spaced end walls and a peripheral wall interconnecting the end walls to form a multi-lobed cavity therebetween and within which housing cavity a piston or rotor is mounted for planetary rotation relative to the housing cavity, the rotor having opposite end faces adjacent the housing end walls and a plurality of flank surfaces converging with each other to form a plurality of circumferentially spaced apex corner or "nose" portions so that the rotor defines with the housing walls a plurality of working chambers which vary in volumetric size and gaseous fluid pressure as the rotor rotates within the housing cavity. The improved seal grid assembly comprises, in combination with a waist seal at each of the junctures of the housing cavity lobes, a seal means secured to and carried in each of the apex portions of the rotor. Each seal means includes a wall the outer surface of which is movable between a retracted position, where it is out of contact with the peripheral housing wall, and an extended position, where it is in engagement with the peripheral housing wall. For each of the seal means is provided a pressure means, including vent passage means, for subjecting the inner surface of the seal means wall to the fluid pressure in the working chambers and thereby providing a pressure differential across the wall of the associated seal means to effect movement of the wall to the extended position after contact of the associated seal means with each of the waist seals has been terminated.

In a narrower aspect of the invention, a space is defined between each seal means and its associated apex portion of the rotor and vent passage means is provided to communicate such space with the working chambers and thereby effect movement of the seal means wall to the retracted position just prior to engagement with a waist seal at each of the lobe junctions and to the extended position after such engagement with each of the waist seals. In addition, movement of the seal means to the retracted position is assisted by the pressure differential across the seal means directed radially inwardly as the seal means passes the waist seals.

In one embodiment of the invention the seal means comprises a flexible plate dimensioned to overlie the peripheral surface of the apex portion of the rotor and extend between the end walls of the housing. The flexible plate is secured to the rotor by at least one slip-joint connection to permit movement of the flexible plate toward and away from the peripheral wall of the housing.

In another embodiment of the invention, the seal means is a corner element receivable in one or more grooves in the associated apex portion of the rotor and secured to the rotor for limited radial movement relative to the grooves and toward and away from the peripheral housing wall.

In a further embodiment of the invention, the seal means is a flexible plate dimensioned to overlie the peripheral surface of the apex portion of the rotor and extend between the housing end walls, which flexible plate is anchored in a flexible manner at opposite end portions to the rotor.

BRIEF DESCRIPTION OF THE DRAWINGS

The invention will be more fully understood from the following detailed description thereof when considered in connection with the accompanying drawings wherein several embodiments of the invention are illustrated by way of example and in which:

FIGS. 5 and 6 are fragmentary plane views of the apex seals shown in FIGS. 1 to 4 with parts broken away for illustration purposes only;

FIG. 7 is an enlarged fragmentary view similar to FIGS. 3 and 4, with parts broken away to better show an alternative passage means to that shown in FIGS. 1 to 6;

FIG. 8 is a fragmentary plane view similar to FIG. 5 showing the slip-joint connection and the vent passage means shown in FIG. 7;

DESCRIPTION OF THE PREFERRED EMBODIMENTS

Figure 2:
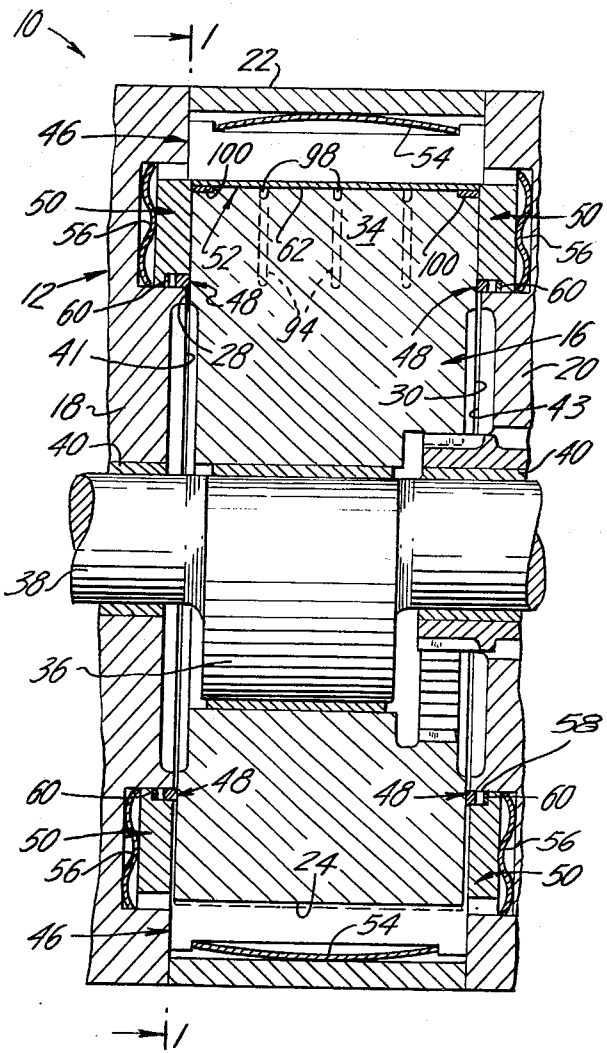
FIG. 2 is a view in cross-section of the rotary piston compressor mechanism of FIG. 1 taken substantially along line 2—2 of FIG. 1.
Figure 1:
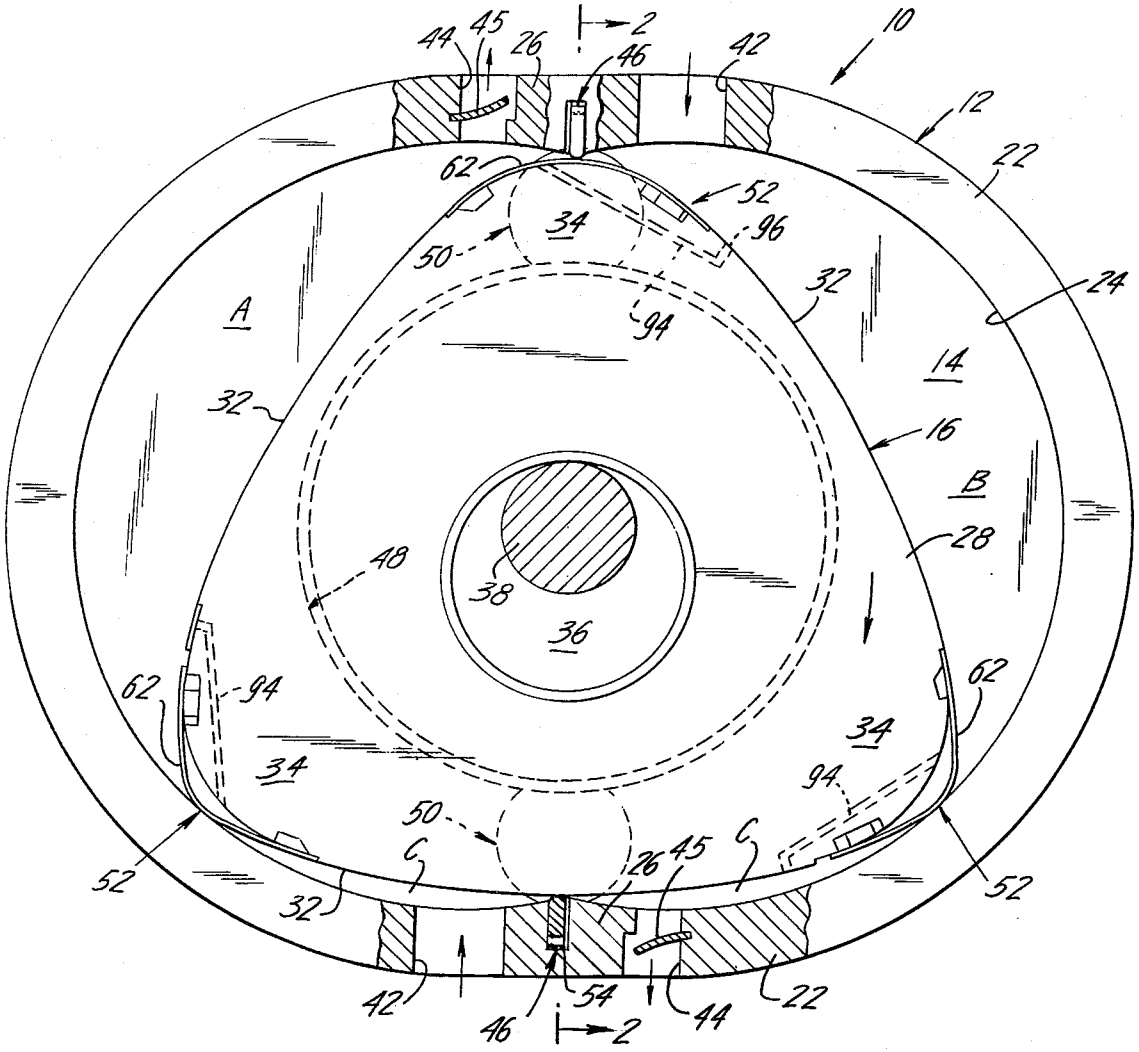
FIG. 1 is a cross-sectional view taken substantially along line 1—1 of FIG. 2 of a rotary piston compressor mechanism of the hypotrochoid type which is provided with an improved seal grid assembly according to a first embodiment of this invention.
Figure 3:
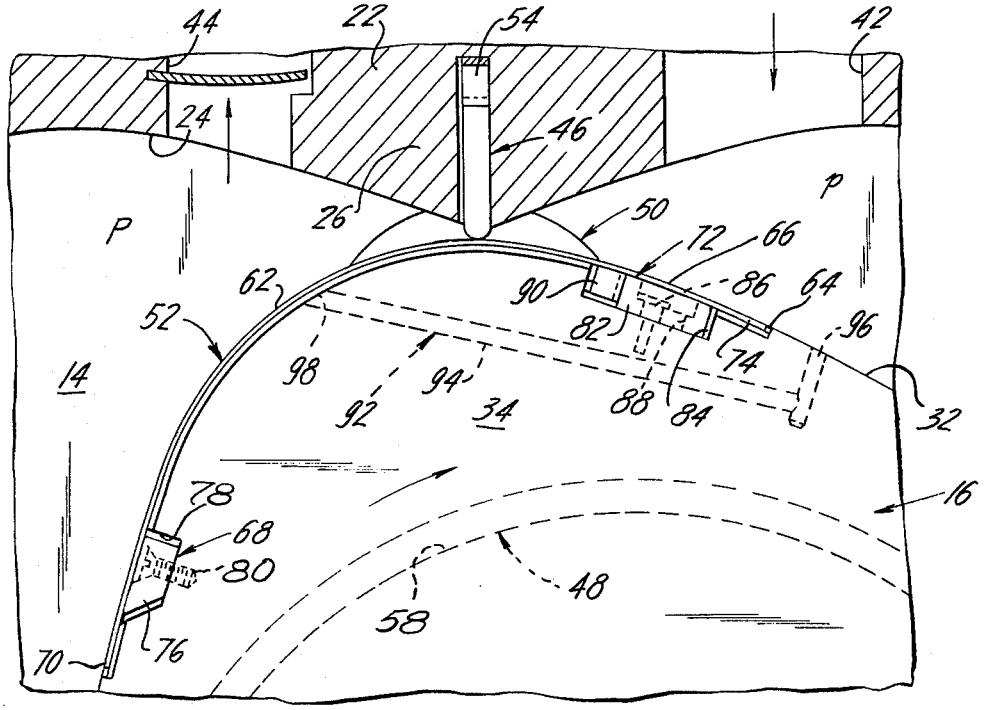
FIG. 3 is an enlarged fragmentary view of one of the corner seals and waist seals which form part of the improved seal grid assembly according to the first embodiment thereof.

Now referring to the drawings and, more particularly, to FIGS. 1 and 2, the reference number 10 generally designates a rotary piston mechanism of the trochoidal type which has a sealing grid assembly according to this invention.

While rotary piston mechanism 10 is shown and will be described as a compressor, it is to be understood that the improved seal grid assembly has application to expansion engines and pumps without departure from the scope and spirit of this invention. Furthermore, while rotary piston mechanism 10 is shown as comprising a housing 12 having a cavity 14 of two lobes within which a rotor 16 of triangular profile rotates, it is to be understood that the invention also has application to rotary piston mechanisms having other than two lobes and a rotor having other than three apex portions. It is still further to be understood that the invention is not limited to a rotary piston mechanism of the hypotrochoidal type as shown, but has application to epitrochoidal types as well as to modifications of such trochoidal types without departing from the scope and spirit of the invention.

In the rotary piston mechanism 10 as shown in FIGS. 1 and 2, housing 12 has end walls 18 and 20 abutting opposite ends of a peripheral wall 22, the walls being suitably secured together by means, such as by bolts and dowels (not shown), to form the multi-lobe housing cavity 14. The peripheral wall 22 has a surface 24 conforming in shape to the trace of a hypotrochoidal or epitrochoidal generated outer envelope of the plural lobe type. As illustrated, the cavity is of the two-lobe type with junctures of the lobes located at 26.

The rotor 16 of the rotary piston mechanism 10 comprises a body portion having opposite, substantially parallel side faces 28 and 30 and three peripheral surfaces or flanks 32. The three flanks 32 converge at opposite ends to give the rotor a generally triangular profile. The area of convergence of the flanks 32 form apex or nose portions 34. The peripheral configuration of rotor 16 is a line parallel to the trace of the inner envelope of a hypotrochoid. In the case of a rotary piston mechanism of the hypotrochoidal type, as shown in the Maillard British Pat. No. 583,035 dated Dec. 5, 1946, the apex or nose portions 34 have a relatively blunt or round configuration. The rotor 16 is supported for planetary rotative movement in cavity 14 by an eccentric portion 36 of a shaft 38 which, in turn, is supported in suitable bearings 40 disposed in end walls 18 and 20. The rotor 16 is of a width which is substantially equal to the width of peripheral wall 22 so that side faces 28 and 30 are in close running fit with the adjacent inner surface 41 and 43 of end walls 18 and 20, respectively. The rotor 16 defines with housing 12 a plurality of working chambers A, B and C, each of which successively expand and contract in volumetric size as rotor 16 rotates in cavity 14 relative to housing 12.

As illustrated, rotary mechanism 10 is a compressor having two inlet or intake ports 42 in peripheral wall 22 and two exhaust or discharge ports 44 in end wall 20. Each of the exhaust ports 44 are preferably provided with check valves 45, schematically shown in FIg. 1. Each of the intake ports 42 are connected by suitable conduits (not shown) to a source of gaseous fluid to be compressed while each of the discharge ports 44 are suitably connected to a place of use or storage of the compressed gaseous fluid (not shown). Each of the working chambers, A, B and C are isloated from each other and surrounding areas by the improved sealing grid assembly, according to this invention.

The sealing grid assembly comprises non-rotative waist seals 46 in the peripheral wall 22 at each lobe juncture 26, annular side seals 48 located in each of end walls 18 and 20, bridge seal discs 50 also disposed in end walls 18 and 20, and a seal means 52 located at each of the apex portions 34 of rotor 16.

Each of the waist seals 46 may be of a single blade construction (as shown) or of multi-blade construction, such as shown in applicant's co-pending U.S. patent application Ser. No. 689,183 filed May 24, 1976, disposed in a guide groove extending radially relative to shaft 38 from surface 24 of peripheral wall 22. A biasing means 54 which may be, as shown, in the form of a spring is provided for each waist seal to resiliently urge the blade associated with the waist seal outwardly of its groove and toward rotor flanks 32. Alternatively, or to supplement biasing means 54, waist seals 46 may also be biased by pressure fluid passed from the compression chambers.

Each of the bridge seal discs 50 is disposed in a cylindrical recess in the inner surfaces 41 and 43 of end walls 18 and 20 and is biased outwardly thereof toward side faces 28 or 30 of rotor 16 by a biasing means 56, such as a spring. Alternatively, or to supplement biasing means 56, bridge seal discs may be biased by pressure of the fluid being compressed.

The annular side seals 48 are each disposed in an annular recess 58 in the respective inner surfaces 41 and 43 of end walls 18 and 20. A biasing means, such as a spring 60, is provided for each side seal 48 to urge it outwardly into engagement with the adjacent side face 28 or 30 of rotor 16. Alternatively, or to supplement spring 60, side seals 48 may also be biased by pressurized fluid conducted from the compression chambers. Each of the annular side seals 48 and seal discs 50 may, as shown, be sized and arranged so that the side seals are within the trace of flanks 32 of rotor 16 and engage each other to thereby completely seal the interstices between rotor side faces 28 and 30 and inner surfaces 41 and 43 of housing end walls 18 and 20. To seal the space between the periphery of each of the apex portions 34 and trochoidal surface 24 of peripheral wall 22, seal means 52, according to a first embodiment of this invention, are provided at each apex portion 34.

As best shown in FIGS. 3 to 6, each seal means 52 comprises a relatively thin flexible plate 62 which is dimensioned to overlie an associated portion of flanks 32 at the apex portions 34 of rotor 16 and of a width sufficient to provide a close running clearance with the inner surfaces 41 and 43 of housing end walls 18 and 20. As illustrated, the flank portions forming the peripheral surface of each of the apex portions 34 may be recessed at 64 to receive plate 62 so that, in the retracted position shown in FIG. 3, the outer surface 66 of the plate lies in a plane substantially coextensive or flush with the adjacent portions of flanks 32. The plate 62 is secured in recess 64 and to rotor 16 by an anchor means 68 adjacent one end 70 and by a slip-joint connection 72 adjacent its opposite end 74.

The anchor means 68 comprises a bar 76 which is secured to the under surface of plate 62 by any suitable means such as welding, soldering, brazing, or adhesive. The bar 76 is positioned and dimensioned to be receivable in a counter-recess 78 in rotor 16. A plurality of spaced holes are provided in the plate and bar 76 to register with tapped holes in the bottom of counter-recess 78. A screw 80 is passed through each hole and turned into the registered tapped hole to fixedly secure plate 62 to the rotor. The screws 80 are counter-sunk so as to be below the outer surface 66 of plate 62. Obviously, other suitable anchor means may be employed to fixedly secure plate 62 to rotor 16 without departing from the scope and spirit of this invention.

The slip-joint connection 72, as shown, comprises a guide bar or block 82 which, similar to bar 76, is secured to the under surface of plate 62 by any suitable means such as welding, brazing, soldering, adhesive or the like. The guide block 82 is disposed in another or second counter-recess 84 in recess 64. The counter-recess 84 is substantially wider than guide block 82 so as to permit movement of the guide block 82 in counter-recess 84. To secure the guide block 82, and hence plate 62 to rotor 16 and also allow relative movement, a plurality of screws 86 extend through elongated or slotted openings 88 and are turned into registered, threaded openings in the bottom of counter-recess 84. The guide block 82 is biased to the right, as viewed in FIGS. 3, 5, 7 and 8 by a spring 90 so that the normal or retracted position of seal means 52, wherein plate 62 is held in recess 64, conforms to the curvature of the peripheral surface of the associated apex portion 34.

Each of the seal means 52 also comprises vent passage means 92 for communicating and venting the under surface of plate 62 to the fluid pressure in the working chambers A, B or C, which is ahead of its associated apex portion 34. In one embodiment shown in FIGS. 2 to 6, each of the passage means 92 comprises a plurality of spaced, substantially parallel bores 94 in apex portion 34 extending from and through the surface of a flank 32 at 96 ahead of or in front of seal means 52, relative to the direction of rotor rotation, to and through the bottom of recess 64 beneath plate 62 at 98. To improve the seal beneath plate 62, two spaced seal strips 100 of suitable resilient material are disposed in counter-recesses in recess 64 adjacent to opposite side faces 28 and 30 of rotor 16.

Figure 4:
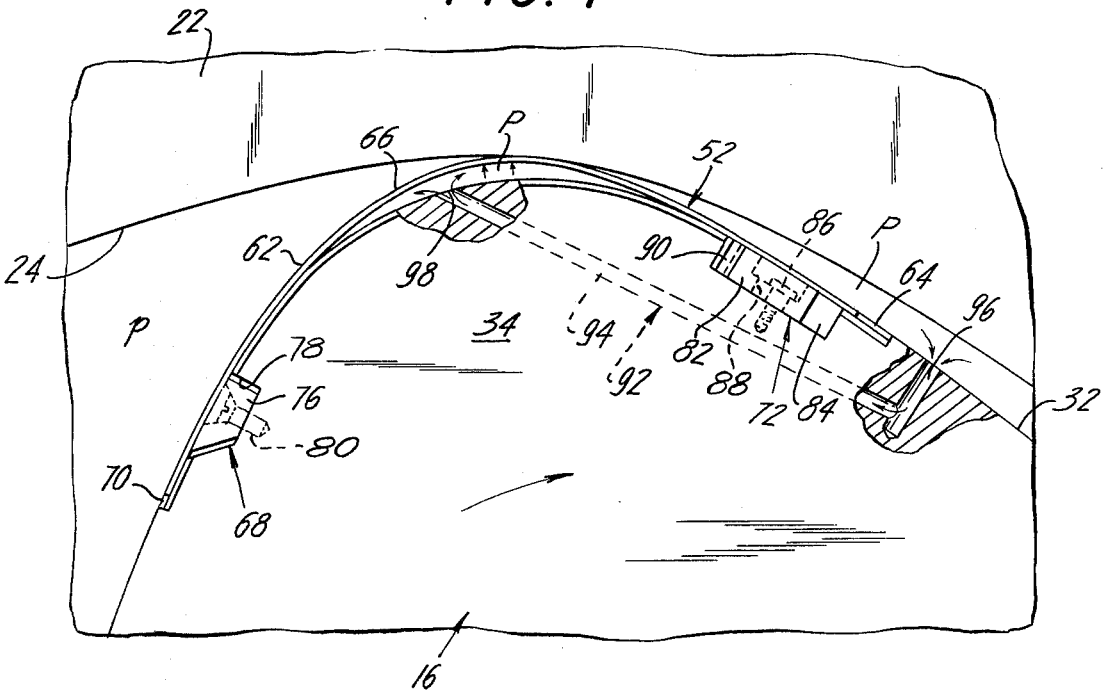
FIG. 4 is another operative view of the apex seal shown in FIG. 3 with the apex seal shown in the extended position and at a point removed from the waist seal.

As has been shown and described herein, anchor means 68 is preferably located relative to rotor rotation at the trailing end portion 70 of flexible plate 62 because it is adjacent this end that the pressure differential across flexible plate 62 is greatest when the flexible plate is in the extended position (see FIG. 4). Thus, at the point of greatest potential leakage a fixed connection is provided which can more easily be sealed than slip-joint connection 72 and fluid leakage minimized.

In operation, each of the seal means 52 functions to move between a retracted and extended position in response to the fluid pressure in working chambers A, B or C ahead of the seal to avoid impact between the waist seals 46 and simultaneously maintain an uninterrupted fluid-tight seal at apex portion 34 during planetary movement of rotor 16. More specifically as viewed in FIG. 4, seal means 52 maintains sealing engagement with surface 24 of peripheral walls 22 by reason of the pressure differential across plate 62 which differential pressure urges plate 62 to bulge radially outward into the extended position of operation. This pressure differential is provided by the conduction of higher pressure fluid, which is being compressed in working chambers A or B ahead of the apex portion, to the under side of plate 62, via bores 94. As seal means 52 approaches each lobe junction 26 and a waist seal 46, the area beneath plate 62 is brought into communication with the working chamber ahead of lobe junction 26, which chamber is then at the latter part of an intake phase and hence is at low pressure. The relative pressures in working chambers A, B and C and the area beneath the seal means is shown by the letters P and *p* in FIGS. 3 and 4. This communication of the under side of plate 62 vents the space under plate 62 to the low pressure in the lead working chamber, which then permits the higher pressure on the outer surface of plate 62 together with the assistance of spring 90 to urge guide block 82 of slip-joint connection to the right, as viewed in FIG. 3, and thereby move plate 62 toward the retracted position shown in FIG. 3. This retraction occurs as plate 62 engages waist seal 46 and thus avoids sharp impact with the latter. Thereafter, as seal means 52 sweeps past waist seal 46, the intake port 42 closes and the working chamber A or B commences a compression phase of operation. Thus, as plate 62 is carried past waist seal 46 and tends to move radially inwardly away from waist seal 46, the increased fluid pressure in the leading working chamber is conducted, via bores 94, to the underside of plate 62 to thereby urge, against the force of spring 90, plate 62 toward its extended position so that the plate 62 achieves a relatively smooth, uninterrupted transfer of sealing contact from waist seal 46 to inner surface 24 of peripheral wall 22. To further insure this smooth passage of seal means 52 past each of the waist seals 46 the leading edge 74 and trailing edge 70 of plate 62 are tapered to avoid impact shocks if the waist seals 46 ride over those joints.

In FIGS. 7 and 8 a passage means 102 is shown which may be employed as an alternative to passage means 92 shown in FIGS. 1 to 6. Parts in FIGS. 7 and 8 which are identical with the parts shown in FIGS. 1 to 6 have been designated by the same reference number.

The passage means 102 consists of a plurality of spaced, substantially parallel grooves 104 located to extend across and beyond the opposite sides of counterrecess 84. Each of these grooves 104 form flow passages extending from a point ahead of plate 62 relative to direction of rotor rotation to a point beneath plate 62. These flow passages serve the same function as herein described for bores 94.

Figure 9:
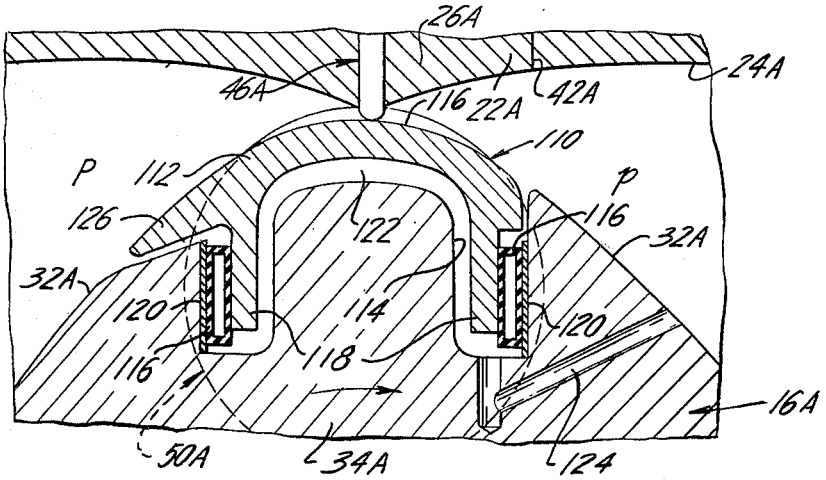
FIGS. 9 and 10 are fragmentary cross-sectional views of the improved seal grid assembly according to another embodiment of the invention, showing two extreme operative positions of the apex seal.
Figure 10:
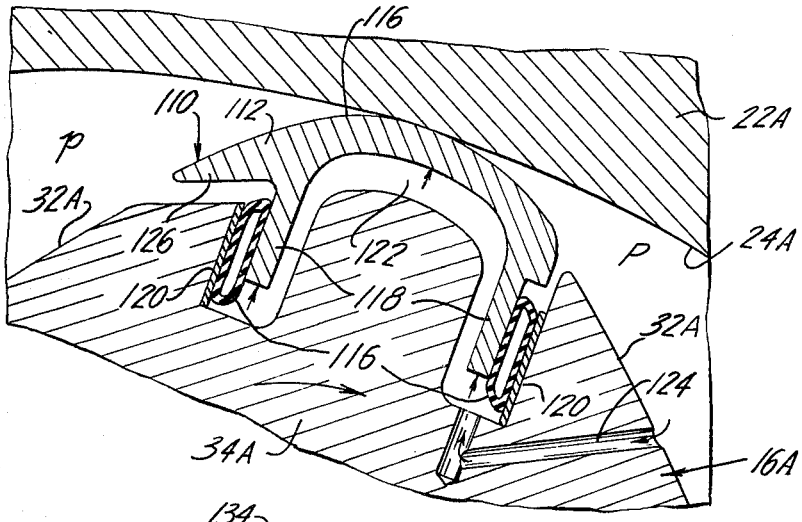

In FIGS. 9 and 10 is shown a seal grid assembly, according to another embodiment of this invention, in which an alternative seal means 110 is illustrated. Parts of this embodiment which are like parts in the embodiment shown in FIGS. 1 to 6 will be designated by the same reference number with the suffix A added thereto.

As shown, this embodiment comprises a plurality of seal means 110 (only one of which is shown) each of which has a body portion 112 of inverted U-shape, in cross-section, and is disposed within an inverted U-shaped groove 114 extending in apex portion 34A across the full width of rotor 16A and radially inwardly. The body portion 112 is dimensioned to extend across the full width of rotor 16A and to have a close running clearance with the inner surfaces (not shown) of the adjacent housing end walls (not shown). The body portion 112 has a curved outer sealing surface 116 which curvature is dimensioned to provide a smooth transition between it and the adjacent surfaces of flanks 32A. To secure body portion 112 in groove 114 for limited reciprocative movement, seal means 110 includes a pair of resilient seal elements 116. Each seal element 116 may comprise a rectangular tube in cross-section made of an elastomer which is bonded on one side to a leg 118 of body portion 112 and to a metal plate 120. The body portion 112, groove 114 and seal elements are so dimensioned that plates 120 are in interference fit with the adjacent side walls of groove 114. The magnitude of the force of the interference fit is selected so that, under normal operating conditions, seal means 110 is secured in groove 114. The body portion 112 and groove 114 define therebetween a chamber 122. This chamber 122 communicates with the working chamber ahead of the seal means relative to the direction of rotor rotation by way of a passage means 124, which may be similar to passage means 92. Thus, body portion 112 will reciprocate to maintain sealing contact without detrimental impacts against waist seals 46A in response to the changes in the fluid pressure in the lead working chamber, in the same manner as heretofore described with respect to the embodiment shown in FIGS. 1 to 6. The inherent resiliency of seal elements 116 function to bias body portion 112 in the retracted position shown in FIG. 9. The relative pressures in working chambers and the area beneath chambers 122 is shown by letters P and *p* in FIGS. 3 and 4.

The body portion 112 may be provided with an extension 126 of the trailing edge thereof to insure smooth transfer of sealing contact between the body portion 112 and waist seal 46A.

Figure 11:
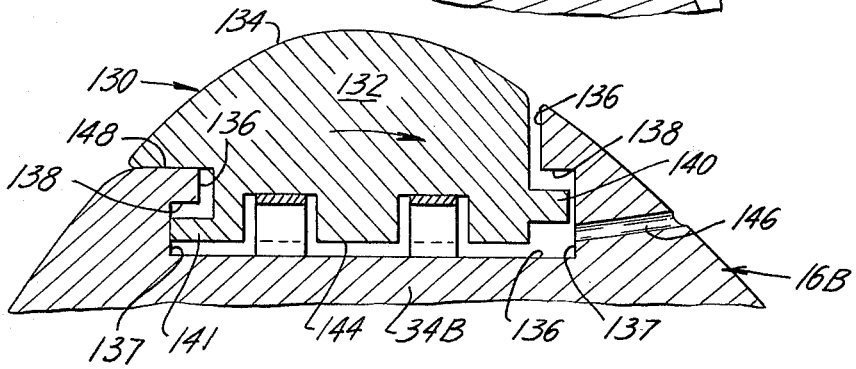
FIG. 11 is a fragmentary view in cross-section of an alternative corner seal which may form part of the improved seal grid assembly of this invention.

In FIG. 11 is shown a seal means 130 which may alternatively be employed in place of seal means 110 shown in FIGS. 9 and 10. This seal means 130 has a body portion 132, the outer surface 134 of which is curved similar to surface 116 of seal means 110. The body portion 132 is disposed in a groove 136 in the apex portion of the rotor. The groove 136 is undercut at 137 to form two shoulders 138 which coact with two flange portions 140 and 141 of body portion 132 to limit radial outward movement of body portion 132. Alternatively, no undercuts 137 need be provided where the grooves, such as 114 or 136, are of a sufficient depth relative to the spring force and the radial clearance so that the seal means 110 or 130 does not leave its associated groove before contacting housing surface 24. The body portion 132 and the bottom of groove 136 define therebetween a chamber 144 which is in communication with the working chamber ahead of seal means 130 relative to the direction of rotor rotation by way of a passage means 146, similar to passage means 92 and 124 of the embodiment shown in FIGS. 3 and 9. The chamber 144 is sealed against leakage or fluid blow-by by contact of the radially extending surface of flange portion 141 against the complementary surface of the adjacent portion of undercut 137. The body portion 132 in all of its positions as it is carried around the housing cavity 14 is subjected to composite forces having components urging those surfaces together and into sealing contact. Inward movement of body portion 132 of seal means 130 is limited by abutment of the body portion 132 against rotor 16B at 148. Thus, seal means 130 functions, in response to changes in fluid pressure in the lead working chambers, to radially reciprocate between an extended and retracted extreme positions to avoid detrimental impacts against the waist seals (not shown) and without loss of sealing effectiveness.

Figure 12:
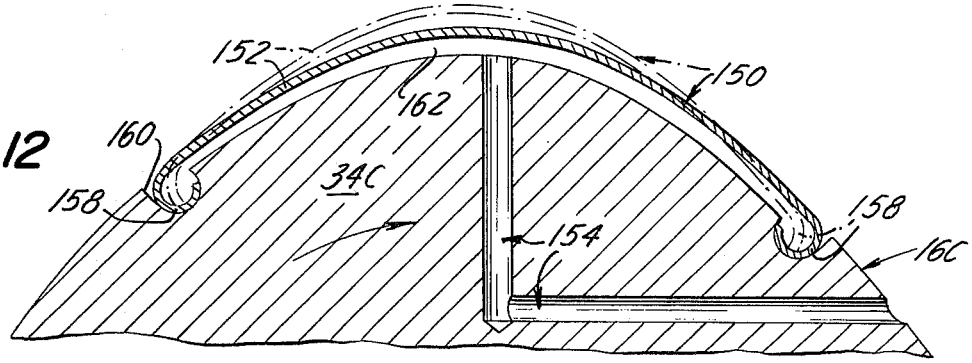
FIG. 12 is a fragmentary cross-sectional view of another form of corner seal which may be employed in the improved seal grid assembly according to this invention.

In FIG. 12 is shown another alternative seal means 150 for each of the apex or corner portions 34C of a rotor 16C which comprises a flexible plate 152 and passage means 154. Each of the plates 152 is dimensioned to cap or overlie a substantial portion of the periphery of the corner portion 34C and is anchored by any suitable means at opposite end portions 158 in a recess 160 in rotor 16C. The periphery of the associated corner portion 34C is recessed between recesses 160 so as to define a space 162 adjacent the underside of plate 152. This space 162, as in the previous embodiments, is in communication with the working chamber ahead of seal means 150, through passage means 154, so that plate 152 flexes between the full and broken line positions in response to the changes in fluid pressure in the lead working chamber. Thus, seal means 152 is operative in the same manner as seal means 52 to obviate detrimental impacts against waist seals (not shown) and provide uninterrupted sealing.

Figure 13:
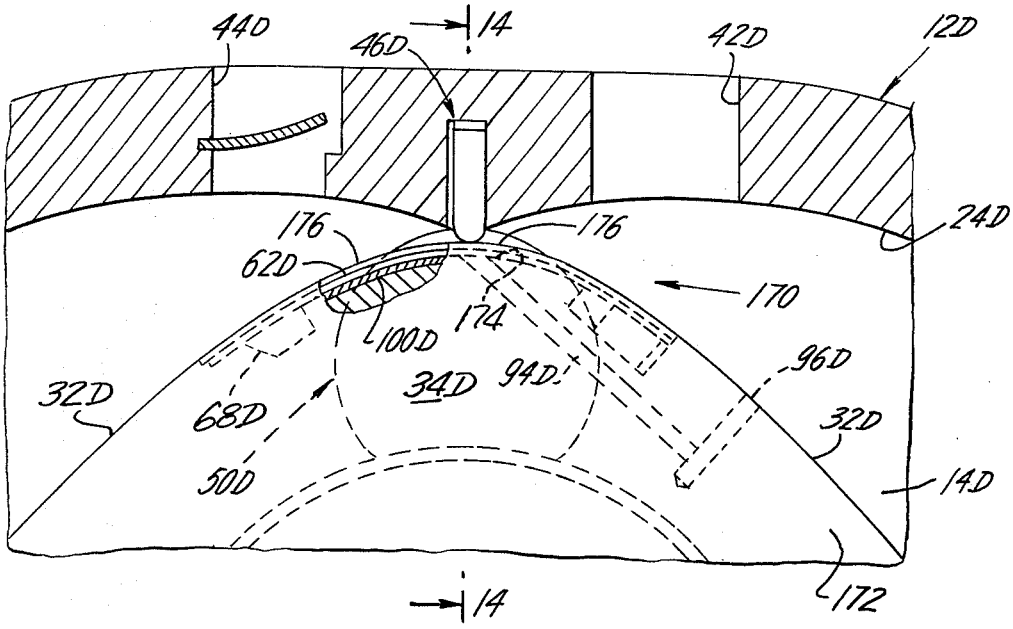
FIG. 13 is a fragmentary cross-sectional view similar to a portion of FIG. 1 showing still another form of corner seal which may be employed in the improved seal grid assembly of the present invention.
Figure 14:
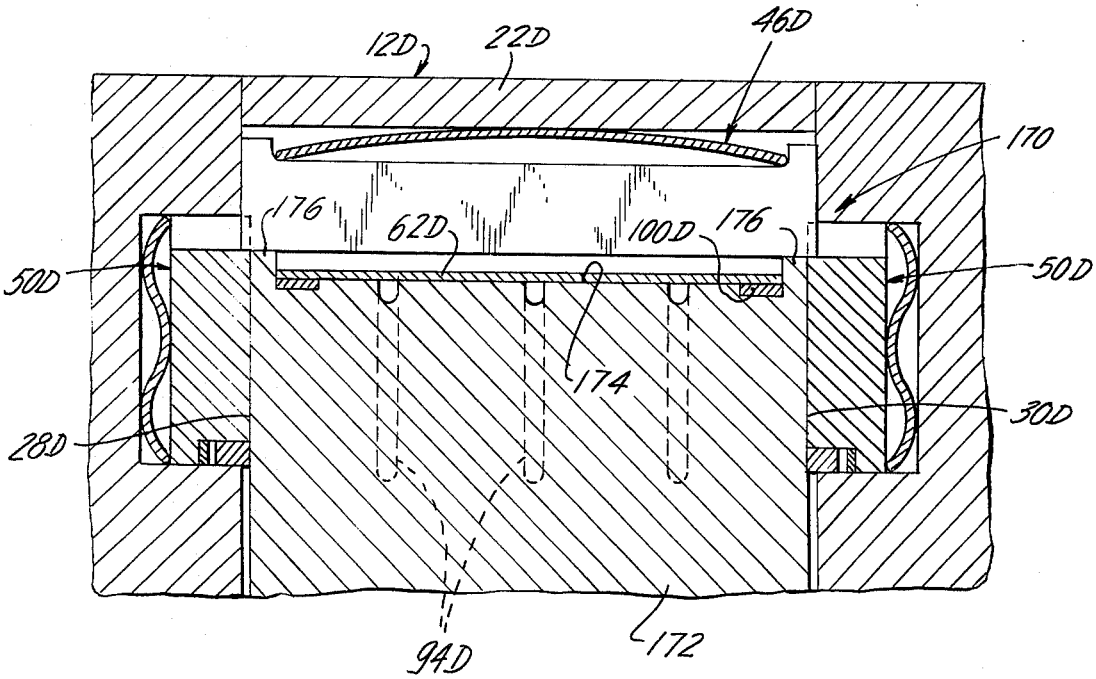
FIG. 14 is a cross-sectional view taken substantially along line 14—14 of FIG. 13.

In FIGS. 13 and 14 is shown still another alternative seal means 170 for each of the apex or corner portions 34D of a rotor 172 which is similar to rotor 16. The seal means 170 is similar to seal means 52 shown in FIGS. 1 to 8 and, therefore, parts of seal means 170 corresponding to parts of seal means 52 will be designated by the same number but with the suffix D added thereto.

The seal means 170 has a flexible plate 62D, anchor means 68D, waist seals 46D and side seals 48D identical in structure and function to those components previously described for the embodiment shown in FIGS. 1 to 8. The only difference is that the apex or corner portions 34D of the flanks 32D of rotor 172 are each provided with a recess 174, similar to recess 64, which is spaced inwardly of the side faces 28D and 30D of the rotor to form two rails 176, best shown in FIG. 4. The flexible plate 62D is dimensioned to fit within the recess 64 and thus between rails 176. The rails 176 are dimensioned to project above the outer surface of flexible plate 62D, when in the retracted position, a small distance, if at all, as for example, between about 0.000 to 0.002 inches. The rails 176 function to minimize leakage at the point where waist seals 46 bridges the gap between the end of recess 64 and the end 70 of flexible plate 62 (see FIG. 6). Leakage is particularly reduced where the use of small amounts of oil in mechanism 10 is permissible. Furthermore, it is to be noted that where the waist seal 46 contacts rails 176 and where therefore blow-by between rails 176 may occur, the differential pressure across the waist seal is relatively low, as compared with the pressure differential at other positions, so that leakage is of small enough amounts to be tolerable. With rails 176 intermittently supporting waist seals 46D, the impact forces to which waist seals 46D are subjected is negligible since the rails follow the trace envelope or generated contour of rotor 172. The other seal means 110, 130 and 150, in addition to seal means 52, may also be employed in combination with rails 176 without departure from the spirit and scope of this invention.

It is believed now readily apparent that this invention provides an improved seal grid assembly for a rotary mechanism of the multi-lobe type which provides improved volumetric efficiency by a unique, automatic coaction of apex seals with non-rotative waist seals whereby detrimental impacts are avoided and uninterrupted sealing is effected.

It is further to be noted that the force exerted against each of the seal means 52, 110, 130, 150 and 170, which urges the sealing members into contact with peripheral housing wall surface 24, is proportional to the differential pressure across the sealing member at the point of contact so that frictional drag or horsepower is automatically no greater than is necessary to achieve sealing contact against surface 24. For this reason and others, seal means 52 of this invention may be employed in a mechanism which does not have a waist seal 46 such as is disclosed in the U.S. Pat. No. 3,323,498, to Kraic et al., dated June 6, 1967.

Although several embodiments of the invention have been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. An improved seal grid assembly for rotary piston mechanisms, having a housing with axially spaced end walls and a peripheral wall interconnecting the end walls to form a multi-lobed cavity therebetween and having a rotor mounted within said cavity for rotation on an axis eccentric to the housing cavity axis, the rotor having opposite end faces adjacent the housing end walls and a plurality of flank surfaces converging with each other to form a plurality of circumferentially spaced apex portions so that the rotor defines with the housing walls a plurality of working chambers which vary in volumetric size and gaseous fluid pressure as the rotor rotates within the housing cavity, the improved seal grid assembly comprises, in combination with a seal blade means at each of the junctures of the housing cavity lobes;

a. a flexible plate seal carried in each of the apex portions of the rotor;

b. each of said flexible plate seals includes a sealing surface movable between a retracted position where it is out of engagement with the peripheral wall and an extended position where it is in engagement with the peripheral wall;

c. each of said flexible plate seals and its associated apex portion of the rotor defining a space therebetween;

d. a mechanical biasing means acting on the flexible plate seal to exert a force on the latter in a direction to urge the sealing surface in a retracted position; and e. passage means in said rotor for each of said flexible plate seals communicating the associated space with the working chambers to conduct gaseous fluid to and from the working chambers and thereby allow movement of an associated flexible plate seal to the retracted position under the urging of the biasing means just prior to engagement with a non-rotating seal element at each of the lobe junctures and to effect movement to the extended position for reengagement with the peripheral wall after such engagement with each of said non-rotating seal elements at the lobe junctures.

2. The apparatus of claim 1 wherein each of said passage means extends through one of the adjacent flank surfaces of the rotor so as to communicate with a working chamber at low pressure just prior to engagement with the seal element at a lobe junction and then with the working chamber when at a higher pressure after disengagement with the seal element.

3. In the rotary piston mechanism of claim 1 wherein said passage means communicates with the working chamber ahead, relative to the direction of rotor rotation, of the associated seal means.

4. The combination of claim 1 in which each of the passage means comprises a plurality of spaced passageways each of which communicates through a flank surface of the rotor with the working chamber and with said space defined between the seal means and rotor.

5. The combination of claim 1 wherein a leakage sealing means is provided to render the space between the apex portion of the rotor and the seal means substantially fluid-tight.

6. The combination of claim 1 wherein said seal means is a flexible plate dimensioned to overlie the peripheral surface of the apex portion of the rotor and extend between the end walls of the housing.

7. The combination of claim 6 wherein seal strips are disposed adjacent the opposite edge portions of the flexible plate which lie adjacent said end walls.

8. The combination of claim 6 wherein said passage means comprises a plurality of spaced passageways each of which communicates at one end with a working chamber and at the opposite end with the space between the apex portion of the rotor and the flexible plate to conduct gaseous fluid from the working chamber to said space.

9. The combination of claim 8 wherein each of said passageways is partly defined by a groove formed in the rotor flank.

10. The combination of claim 6 wherein a securing means is provided for connecting the flexible plate to the rotor and permitting movement of the flexible plate toward and away from the peripheral wall of the housing.

11. The combination of claim 10 wherein said securing means includes at least one slip-joint connection biased in one operative position.

12. The combination of claim 11 wherein said mechanical biasing means is a spring disposed to bias the slip-joint connection in a direction where the flexible plate is in a retracted position.

13. A seal means for each of the apex portions of a rotor for a rotary compressor or expansion engine having a housing with axially spaced end walls and a peripheral wall interconnecting the end walls to form a multi-lobed cavity therebetween and with the rotor mounted within said cavity for rotation on an axis eccentric to the housing cavity axis, the rotor having opposite side faces adjacent the housing end walls and a plurality of flank surfaces converging with each other to form a plurality of circumferentially-spaced apex portions so that the rotor defines with the housing walls a plurality of working chambers which successively expand and contract in volumetric size and increase and decrease in gaseous fluid pressure as the rotor rotates relative to the housing cavity, the seal means comprising:

a. a recess in the flank surface of an apex portion of said rotor;

b. a flexible plate having an inner and outer surface receivable in said recess;

c. anchor means for securing said flexible plate at one end to the rotor;

d. a slip-joint connection for securing the opposite end of said flexible plate to said rotor to permit said flexible plate to move between a retracted position where its outer surface is out of contact with the peripheral housing wall and an extended position where its outer surface engages the peripheral housing wall;

e. a spring means coacting with said flexible plate to exert a force on said flexible plate in a direction urging the latter in the retracted position; and f. pressure means including passage means for subjecting the inner surface of the flexible plate to the gaseous pressure in the working chambers to provide a pressure differential across the flexible plate to effect movement of said wall to the extended position.

* * * * *